US005709758A

United States Patent [19]

Okamoto et al.

[11] Patent Number: 5,709,758

[45] Date of Patent: Jan. 20, 1998

[54] PROCESS FOR PRODUCING STRUCTURAL MEMBER OF ALUMINUM ALLOY

[75] Inventors: Kenji Okamoto; Hiroyuki Horimura; Masahiko Minemi, all of Saitama; Yoshinobu Takeda, Hyogo; Yoshishige Takano, Hyogo; Toshihiko Kaji, Hyogo, all of Japan

[73] Assignees: Sumitomo Electric Industries, Ltd., Osaka; Honda Giken Kogyo Kabushiki Kaisha, Tokyo, both of Japan

[21] Appl. No.: 664,787

[22] Filed: Jun. 17, 1996

Related U.S. Application Data

[63] Continuation of Ser. No. 286,553, Aug. 5, 1994, abandoned.

[30] Foreign Application Priority Data

Aug. 6, 1993 [JP] Japan ..... 5-195858

[51] Int. Cl.[6] ..... B22F 3/02

[52] U.S. Cl. ..... 148/514; 419/66; 419/68

[58] Field of Search ..... 148/514, 549, 148/552, 688, 437, 438, 439, 440; 419/66, 67, 68, 69

[56] References Cited

U.S. PATENT DOCUMENTS

| | | | |
|---|---|---|---|
| 5,053,085 | 10/1991 | Masumoto et al. | 148/439 |
| 5,073,215 | 12/1991 | Skinner et al. | 148/415 |
| 5,330,704 | 7/1994 | Gilman | 419/60 |

FOREIGN PATENT DOCUMENTS

0533950A1 3/1993 European Pat. Off. .

OTHER PUBLICATIONS

56–Nonferous Metals Article—1992, p. 313, Chemicals Abstracts, vol. 117, No. 14; Abstract No. 135901z.

*Primary Examiner*—George Wyszomierski

*Attorney, Agent, or Firm*—Lyon & Lyon LLP

[57] ABSTRACT

An aluminum alloy structural member is crystalline. In producing this aluminum alloy structural member, a procedure is employed which includes forming a green compact by use of aluminum alloy having an amorphous phase, and subjecting the green compact to a powder forging technique. An aluminum alloy powder exhibiting an exotherm E smaller than 20 J/g at the time of the crystallization of the amorphous phases is used. By setting the exotherm E in such a range, cracking of the green compact due to a degassing can be avoided, even if the green compact is rapidly heated in a temperature-rising or heating course.

18 Claims, 3 Drawing Sheets

PROCESS FOR PRODUCING STRUCTURAL MEMBER OF ALUMINUM ALLOY

This is a continuation of application Ser. No. 08/286,553 filed on Aug. 5, 1994, now abandoned.

BACKGROUND OF THE INVENTION

1. Field of the Invention

The present invention relates to a process for producing a structural member of aluminum alloy, and particularly, to a process for producing a structural member having a stable phase by forming a green compact using an aluminum alloy powder having a metastable phase and then subjecting the green compact to a powder forging technique.

2. Description of the Prior Art

There are conventionally known processes for producing a structural member in which a quenched and solidified aluminum alloy powder is used for the purpose of improving the mechanical properties of the structural member, and a powder forging technique is utilized (see Japanese Patent Application Laid-open No.74807/1992).

The quenched and solidified aluminum alloy powder has $Al_2O_3$ film on the surface of each particle. This film causes the bonding of particles to be obstructed, but particles of the quenched and solidified aluminum alloy powder are crystalline. Under application of a powder forging technique, the main aluminum alloy portion under the $Al_2O_3$ film is entirely thermally expanded to break the $Al_2O_3$ film, thereby permitting the main aluminum alloy portions to be bonded to one another. This avoids such disadvantage due to the $Al_2O_3$ film.

If an aluminum alloy having a metastable phase is transformed in phase, the metallographic structure of the aluminum alloy after the phase-transformation is more fine and uniform than that of the quenched and solidified aluminum alloy. Therefore, if this crystalline aluminum alloy is applied to the production of a structural member, it is possible to produce a structural member having further improved mechanical properties.

From such a viewpoint, an attempt has been made to prepare aluminum alloy powder having a metastable phase, for example, by a high pressure gas atomizing process and to produce a structural member by utilizing a powder forging technique.

However, the phase-transformation of the metastable phases is accompanied by an exothermic action and a volumetric shrinkage. Therefore, if aluminum alloy powder exhibiting an exotherm E equal to or more than 20 J/g is used, when the green compact is rapidly heated in a temperature-rising or heating course to start the phase-transformation of the aluminum alloy powder particles in a surface layer of the green compact, the phase-transformation is further promoted by a large exotherm E generated at the time of the phase-transformation, so that it is spread to the internal aluminum alloy particles. Thus, the phase-transformation is rapidly advanced in the entire region of the green compact and with this advancement, the volumetric shrinkage of the aluminum alloy powder is likewise rapidly advanced.

In this case, there is a problem that a relatively large amount of hydrogen is absorbed because the aluminum alloy powder has the metastable phases, and for this reason, a degassing vigorously occurs not only in the surface layer but also in the internal area of the green compact, which causes cracks.

If aluminum alloy powder exhibiting a percent volumetric shrinkage R larger than 1.2% at the time of the phase-transformation is used, the following problem is encountered: the breaking of the $Al_2O_3$ film is not sufficiently achieved at a temperature rising course due to a large volumetric shrinkage of the main aluminum alloy portion located under the $Al_2O_3$ film on the surface, resulting in an insufficient bonding of the aluminum alloy powder particles and hence, it is impossible to improve the mechanical properties of the structural member, as expected.

SUMMARY OF THE INVENTION

It is a first object of the present invention to provide a producing process of the type described above, wherein the generation of cracks in the green compact can be avoided to produce a sound structural member by using aluminum alloy powder having a metastable phase and exhibiting a specified exotherm E generated at the time of the phase-transformation.

To achieve the first object, according to the present invention, there is a process for producing a structural member of aluminum alloy, comprising the steps of: forming a green compact by use of aluminum alloy powder having a metastable phase, and subjecting the green compact to a powder forging technique to provide a structural member having a stable phase, wherein the aluminum alloy powder used is an aluminum alloy powder which exhibits an exotherm E smaller than 20 J/g at the time of the phase-transformation of the metastable phases.

When the aluminum alloy powder exhibiting the specified exotherm E is used as described above, even if the green compact is rapidly heated at a temperature-rising or heating course to start the phase-transformation of the metastable phases in the aluminum alloy particles in a surface layer, the exotherm E generated with such phase-transformation is small. Therefore, the spreading of the phase-transformation to the aluminum alloy powder particles within the green compact is suppressed, thereby permitting the phase-transformation to be slowly and gradually advanced from the outer layer to the inner area. The volumetric shrinkage of the aluminum alloy powder also follows a similar progress. Therefore, a degassing is gradually advanced inwardly from the outer layer of the green compact, and as a result, the generation of cracks in the green compact is avoided. This makes it possible to produce a sound aluminum alloy structural member having excellent mechanical properties.

It is a second object of the present invention to provide a producing process of the type described above, wherein by using aluminum alloy powder having a metastable phase and exhibiting a specified exotherm E and a specified percent volumetric shrinkage R at the time of the phase-transformation thereof, cracking of the green compact can be avoided, and aluminum alloy powder particles can be bonded to one another, thereby producing a structural member having excellent mechanical properties.

To achieve the above second object, according to the present invention, there is provided a process for producing a structural member of aluminum alloy, comprising the steps of: forming a green compact by use of aluminum alloy powder having a metastable phase, and subjecting the green compact to a powder forging technique to provide a structural member having a stable phase, wherein the aluminum alloy powder used is an aluminum alloy powder which exhibits an exotherm E smaller than 20 J/g and the percent volume shrinkage R is equal to or smaller than 1.2% at the time of the phase-transformation of the metastable phases.

If the aluminum alloy powder satisfying the condition for the exotherm E and exhibiting the specified percent volumetric shrinkage R is used as described above, the volumetric shrinkage of the main aluminum alloy portion located under the $Al_2O_3$ film on the surface is suppressed to show an expanding tendency and hence, the breaking of the $Al_2O_3$ films is sufficiently performed to realize the bonding of the main aluminum alloy portions to one another. Thus, it is possible to produce a sound aluminum alloy structural member having excellent mechanical properties.

Further, it is a third object of the present invention to provide a producing process of the type described above, wherein by using aluminum alloy powder having a stable phase prepared through the phase-transformation of a metastable phase, a structural member having excellent mechanical properties can be produced without the need for considerations associated with the cracking of the green compact and the bondability of the aluminum alloy powder particles to one another.

To achieve the above third object, according to the present invention, there is provided a process for producing a structural member of aluminum alloy, comprising the steps of: forming a green compact by use of an aluminum alloy powder having a stable phase prepared through the phase-transformation of the metastable phase and then subjecting the green compact to a powder forging technique to provide a structural member.

When the aluminum alloy powder prepared through the phase-transformation of the metastable phases, i.e., exhibiting an exotherm E equal to 0 J/g and a percent volumetric shrinkage R equal to 0% is used, the need for the considerations associated with the cracking of the green compact and the bondability of the aluminum alloy powder particles to one another in the powder forging course is eliminated.

The above and other objects, features and advantages of the invention will become apparent from the following description of a preferred embodiment taken in conjunction with the accompanying drawings.

DESCRIPTION OF THE PREFERRED EMBODIMENT

EXAMPLE 1

A molten metal having a composition comprising $Al_{91.5}Fe_5Ti_{1.5}Si_2$ (each of the numerical values represents % by atom) was prepared and subjected to a high pressure gas atomizing process under a condition of an He gas pressure of 9.8 MPa to produce aluminum alloy powder.

The aluminum alloy powder was subjected to a classification to select aluminum alloy powder particles having a particle size equal to or less than 22 μm. The aluminum alloy powder with the particles having a particle size equal to or less than 22 μm was subjected to an X-ray diffraction and as a result, it was ascertained that the powder had amorphous phases which are metastable phases.

Figure 1:
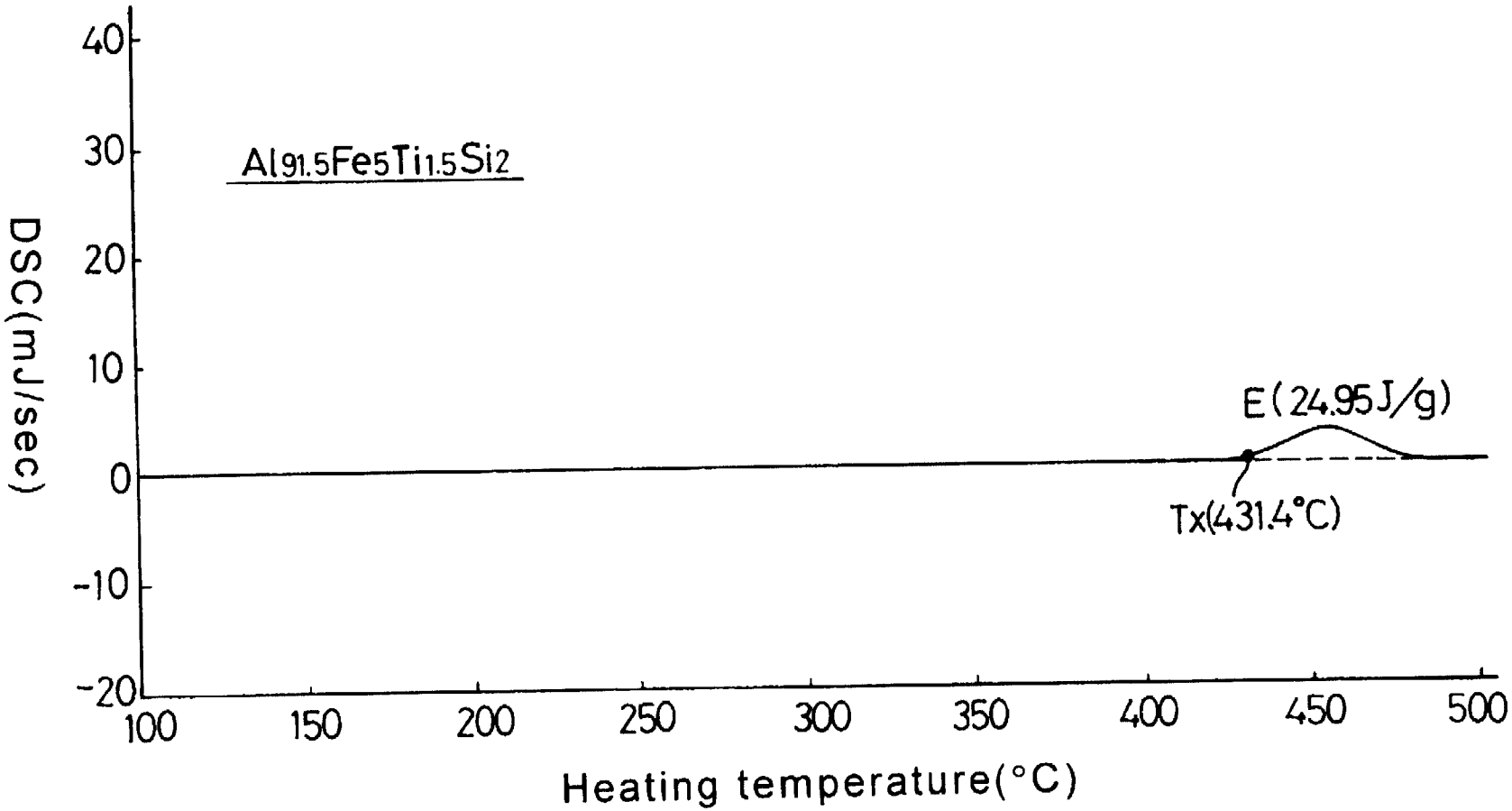
FIG. 1 is a graph illustrating results of a differential scanning calorimetry for one example of aluminum alloy powders.

In addition, a differential scanning calorimetry (DSC) for the aluminum alloy powder provided results shown in FIG. 1. It was ascertained from FIG. 1 that the temperature of phase-transformation of metastable phases, i.e., the crystallization temperature Tx of the amorphous phases in the aluminum alloy powder was equal to 431.4° C., and the exotherm E generated at the time of the phase-transformation of the metastable phases, i.e., at the time of the crystallization of the amorphous phases was equal to 24.95 J/g. Further, a density "$d_1$" of the aluminum alloy powder was measured to provide a value of 2.905 g/cm$^3$.

Then, the aluminum alloy powder was subjected to a primary thermal treatment at a temperature set at 400° C. for varied times to provide various types of aluminum alloy powders having different degrees of crystallization. A differential scanning calorimetry was carried out for each of the aluminum alloy powders to determine an exotherm E generated at the time of the crystallization after the primary thermal treatment, and a density $d_1$ of each powder was measured.

Further, a sample was taken from each of the aluminum alloy powders after the primary thermal treatment, and subjected to a secondary thermal treatment at 600° C. for one minute, followed by a differential scanning calorimetry for each sample to determine an exotherm E generated at the time of the crystallization after the secondary thermal treatment. The results showed that the exotherm E was equal to 0 J/g, and each sample was completely crystallized by the secondary thermal treatment and each sample has only crystalline phases which are stable phases. In addition, a density $d_2$ of each sample was measured to provide a value equal to 2.950 g/cm$^3$.

Then, each of the aluminum alloy powders provided after the primary thermal treatment was subjected to a uniaxial compaction forming under a condition of a compacting pressure of 5 tons/cm$^2$ to form various green compacts having a diameter of 76 mm and a thickness of 23 mm.

Thereafter, each of the green compacts was placed into a high frequency induction heating furnace and heated for about 6 minutes up to 600° C. The nature of the green compacts was observed so as to remove the green compact with cracks generated therein, and each of other green compacts was placed into a die in a powder forging machine, where it was subjected to powder forging under a compacting pressure of 7 tons/cm$^2$, thereby producing various structural members having a diameter of 78 mm and a thickness of 20 mm.

Figure 2:
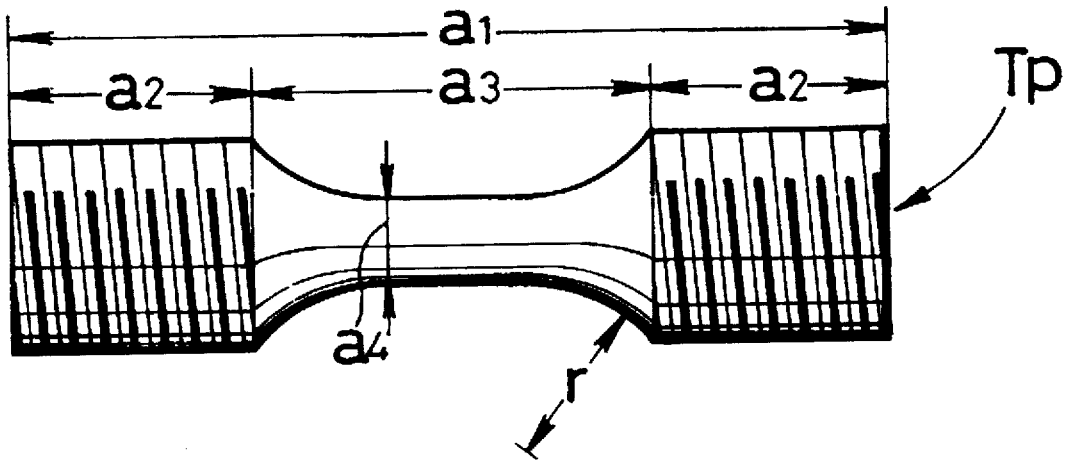
FIG. 2 is a front view of a test piece.

A test piece Tp as shown in FIG. 2 was fabricated from each of the structural members and subjected to a tensile test at room temperature. In addition, the amount of residual hydrogen was determined for each of the structural members. In the test piece Tp shown in FIG. 2, the entire length $a_1$ is 52 mm; the length $a_2$ of each threaded portion is 14 mm; the length $a_3$ between the opposite threaded portions is 24 mm; the diameter $a_4$ of the small diameter portion is 4.8 mm; the radius r of the portion between the small diameter portion and the threaded portion=10 mm; the nominal size is M12, and the pitch is 1.25.

Table 1 shows, for the various aluminum alloy powders (1) to (7), the time of primary thermal treatment and the like, the presence or absence of cracks, and the tensile strength and the like for the structural members corresponding to these aluminum alloy powders, respectively. In Table 1, the percent volumetric shrinkage R was determined from the density $d_1$ after the primary thermal treatment and the density $d_2$ after the secondary thermal treatment according to an expression:

$$R=\{1-d_1/d_2)\}\times 100(\%)$$

The aluminum alloy powder (1) was not subjected to the primary thermal treatment, i.e., Table 1 shows zero minutes of primary thermal treatment.

TABLE 1

| aluminum alloy powder | Time of primary thermal treatment (min.) | After primary thermal treatment: Density $D_1$ (g/cm$^3$) | Exotherm E (J/g) | Percent volumetric shrinkage R (%) | Presence or absence of cracks in green compact | Structural member: Tensile strength (MPa) | Elongation (%) | Amount of residual hydrogen (ppm) |
|---|---|---|---|---|---|---|---|---|
| (1) | 0 | 2.905 | 24.95 | 1.54 | present | — | — | — |
| (2) | 2 | 2.908 | 22.30 | 1.42 | present | — | — | — |
| (3) | 5 | 2.911 | 20.20 | 1.32 | present | — | — | — |
| (4) | 10 | 2.913 | 15.31 | 1.25 | absent | 623 | 0.8 | 2.3 |
| (5) | 15 | 2.916 | 10.11 | 1.15 | absent | 718 | 5.9 | 2.1 |
| (6) | 30 | 2.930 | 3.01 | 0.68 | absent | 720 | 6.3 | 2.1 |
| (7) | 60 | 2.950 | 0 | 0 | absent | 721 | 6.0 | 2.0 |

As apparent from Table 1 for the aluminum alloy powders (4) to (6), the exotherm E after the primary thermal treatment is a value smaller than 20 J/g and therefore, cracks are not generated in each of the green compacts in the temperature-rising course and as a result, a sound structural member can be produced.

Especially for the aluminum alloy powders (5) and (6), the condition of the exotherm E is satisfied, and the percent volumetric shrinkage R after the primary thermal treatment is a value equal to or smaller than 1.2%, and hence, the strength and ductility of the structural members corresponding to these aluminum alloy powders was high. Therefore, it is possible to produce a structural member having excellent mechanical properties by using the aluminum alloy powders (5) and (6).

For the aluminum alloy powder (7), the exotherm E is 0 J/g, and the percent volumetric shrinkage R is 0% and therefore, it is possible to produce a structural member having excellent mechanical properties even by using the aluminum alloy powder (7).

EXAMPLE 2

A molten metal having a composition comprising $Al_{90}Fe_6Ti_2Si_2$ (each of the numerical values represents % by atom) was prepared and subjected to a high pressure gas atomizing process under a condition of an He gas pressure of 9.8 MPa to produce aluminum alloy powder.

The aluminum alloy powder was subjected to a classification to select aluminum alloy powder particles having a particle size equal to or less than 22 μm. The aluminum alloy powder with the particles having a particle size equal to or less than 22 μm was subjected to an X-ray diffraction and as a result, it was ascertained that the powder had amorphous phases.

Figure 3:
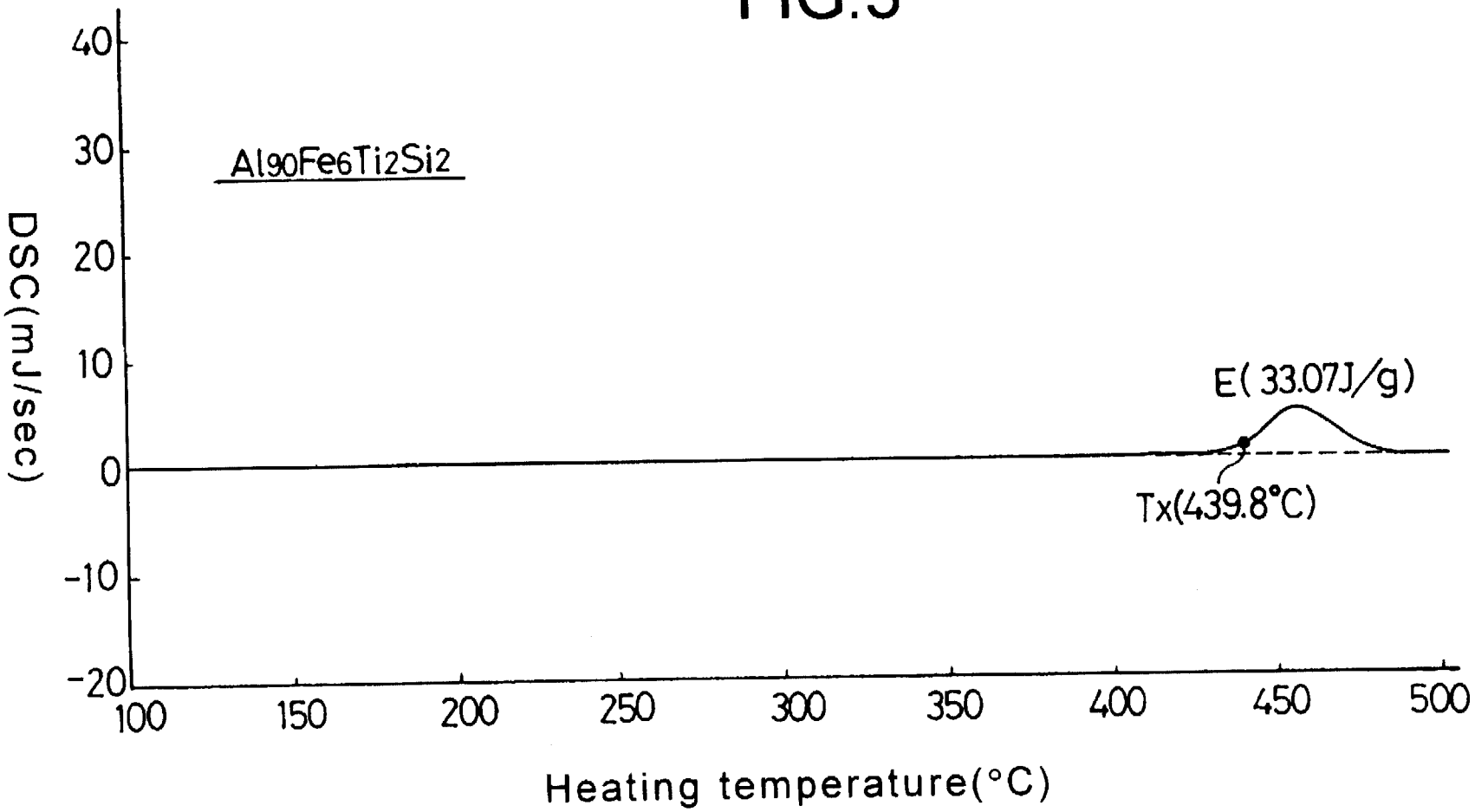
FIG. 3 is a graph illustrating results of a differential scanning calorimetry for another example of aluminum alloy powders.

In addition, a differential scanning calorimetry (DSC) for the aluminum alloy powder provided results shown in FIG. 3. It was ascertained from FIG. 3 that the crystallization temperature Tx of the amorphous phases in the aluminum alloy powder was 439.8° C., and the exotherm E generated at the time of the crystallization of the amorphous phases was 33.07 J/g. Further, a density "$d_1$" of the aluminum alloy powder was measured to provide a value of 2.976 g/cm$^3$.

Then, the aluminum alloy powder was subjected to a primary thermal treatment at a temperature set at 400° C. for varied times to provide various types of aluminum alloy powders having different degrees of crystallization. A differential scanning calorimetry was carried out for each of the aluminum alloy powders to determine an exotherm E generated at the time of the crystallization after the primary thermal treatment, and a density $d_1$ of each powder was measured.

Further, a sample was taken from each of the aluminum alloy powders after the primary thermal treatment, and subjected to a secondary thermal treatment for one minute, followed by a differential scanning calorimetry for each sample to determine an exotherm E generated at the time of the crystallization after the secondary thermal treatment. The results showed that the exotherm E was equal to 0 J/g, and each sample was completely crystallized by the secondary thermal treatment and each sample has only crystalline phases. In addition, a density $d_2$ of each sample was measured to provide a value equal to 3.021 g/cm$^3$.

Then, each of the aluminum alloy powders provided after the primary thermal treatment was subjected to a uniaxial compaction forming under a condition of a compacting pressure of 5 tons/cm$^2$ to form various green compacts having a diameter of 76 mm and a thickness of 23 mm.

Thereafter, each of the green compacts was placed into a high frequency heating furnace and heated for about 6 minutes up to 600° C. The nature of the green compacts was observed so as to remove the green compact with cracks generated therein, and each of remaining green compacts was placed into a mold in a powder forging machine, where it was subjected to a powder forging treatment under a compacting pressure of 7 tons/cm$^2$, thereby producing various structural members having a diameter of 78 mm and a thickness of 20 mm.

Likewise, a test piece Tp as shown in FIG. 2 was fabricated from each of the structural members and subjected to a tensile test at ambient temperature. In addition, the amount of residual hydrogen was determined for each of the structural members.

Table 2 shows, for the various aluminum alloy powders of this Example 2, the time of primary thermal treatment and the like, the presence or absence of cracks, and the tensile strength and the like for the structural members corresponding to these aluminum alloy powders, respectively In Table 2, the percent volumetric shrinkage R was determined from the density $d_1$ after the primary thermal treatment and the density $d_2$ after the secondary thermal treatment according to the above-described expression. The aluminum alloy powder (1) was not subjected to the primary thermal treatment.

TABLE 2

| aluminum alloy powder | Time of primary thermal treatment (min.) | After primary thermal treatment: Density $D_1$ (g/cm$^3$) | Exotherm E (J/g) | Percent volumetric shrinkage R (%) | Presence or absence of cracks in green compact | Structural member: Tensile strength (MPa) | Elongation (%) | Amount of residual hydrogen (ppm) |
|---|---|---|---|---|---|---|---|---|
| (1) | 0 | 2.976 | 33.07 | 1.49 | present | — | — | — |
| (2) | 12 | 2.982 | 23.01 | 1.29 | present | — | — | — |
| (3) | 15 | 2.984 | 19.18 | 1.22 | absent | 641 | 0.2 | 2.1 |
| (4) | 20 | 2.988 | 15.34 | 1.09 | absent | 750 | 4.6 | 1.9 |
| (5) | 25 | 2.992 | 12.11 | 0.96 | absent | 748 | 5.0 | 2.0 |
| (6) | 30 | 3.001 | 8.03 | 0.66 | absent | 757 | 4.8 | 1.8 |
| (7) | 60 | 3.020 | 0 | 0.03 | absent | 751 | 5.1 | 2.1 |

As apparent from Table 2, for the aluminum alloy powders (3) to (6), the exotherm E after the primary thermal treatment is a value smaller than 20 J/g and therefore, cracks are not generated in each of the green compacts in the temperature-rising course and as a result, a sound structural member can be produced.

Especially for the aluminum alloy powders (4) to (6), the condition of the exotherm E was satisfied, and the percent volumetric shrinkage R after the primary thermal treatment was a value equal to or less than 1.2%, and hence, the strength and ductility of the structural members corresponding to these aluminum alloy powders was high. Therefore, it is possible to produce a structural member having excellent mechanical properties by using the aluminum alloy powders (4) to (6).

For the aluminum alloy powder (7), the exotherm E is equal to 0 J/g, and the percent volumetric shrinkage R is equal to 0% and therefore, it is possible to produce a structural member having excellent mechanical properties even by using the aluminum alloy powder (7).

What is claimed is:

1. A process for producing a structural member of aluminum alloy having a stable phase, comprising the steps of:

subjecting a first aluminum alloy powder having a metastable phase and exhibiting an exotherm E of $E \geqq 20$ J/g at the time of the phase-transformation of the metastable phase to the stable phase to a thermal treatment, thereby providing a second aluminum alloy powder having the metastable phase, a surface with an $Al_2O_3$ film covering the surface, and an exotherm E of $E<20$ J/g;

forming a green compact by use of said second aluminum alloy powder;

subjecting the green compact to a heating treatment thereby raising the green compact to a high temperature and breaking the $Al_2O_3$, film; and subjecting the green compact, which has been heated to the high temperature, to a powder forging technique to provide the structural member.

2. A process for producing a structural member of aluminum alloy having a stable phase, comprising the steps of:

subjecting a first aluminum alloy powder having a metastable phase and exhibiting an exotherm E of $E \geqq 20$ J/g and a percent volume shrinkage R of $R>1.2\%$ at the time of the phase-transformation of the metastable phase to the stable phase to a thermal treatment, thereby providing a second aluminum alloy powder having the metastable phase, a surface with an $Al_2O_3$ film covering the surface, and exhibiting an exotherm E of $E<20$ J/g and a percent volume shrinkage R of $R \geqq 1.2\%$;

forming a green compact by use of a said second aluminum alloy powder;

subjecting the green compact to a heating treatment thereby raising the green compact to a high temperature and breaking the $Al_2O_3$ film; and subjecting the green compact, which has been heated to the high temperature, to a powder forging technique to provide the structural member.

3. A process for producing a structural member of aluminum alloy having a stable phase, comprising the steps of:

subjecting a first aluminum alloy powder having a metastable phase to a thermal treatment, thereby providing a second aluminum alloy powder having the stable phase, a surface with an $Al_2O_3$ film covering the surface, and exhibiting an exotherm E of E=O J/g and a percent volume shrinkage R of $R \leqq 0\%$;

forming a green compact by use of said second aluminum alloy powder;

subjecting the green compact to a heating treatment thereby raising the green compact to a high temperature and breaking the $Al_2O_3$ film; and subjecting the green compact, which has been heated to the high temperature, to a powder forging technique to provide the structural member.

4. A process for producing a structural member of aluminum alloy having a stable phase, comprising the steps of:

subjecting a first aluminum alloy powder having a metastable phase and exhibiting a percent volume shrinkage R of $R>1.2\%$ at the time of the phase-transformation of the metastable phase, to a thermal treatment, thereby providing a second aluminum alloy powder having the metastable phase, a surface with an $Al_2O_3$ film covering the surface, and exhibiting a percent volume shrinkage R or $R \leqq 1.2\%$;

forming a green compact by use of said second aluminum alloy powder;

subjecting the green compact to a heating treatment thereby raising the green compact to a high temperature and breaking the $Al_2O_3$ film; and subjecting the green compact, which has been heated to the high temperature, to a powder forging technique to provide a structural member.

5. The process of claim 1, 2, 3 or 4, wherein the first aluminum alloy powder is $Al_{91.5}Fe_5Ti_{1.5}Si_2$, where each numerical value represents percent by atom.

6. The process of claim 1, 2, 3 or 4, wherein the first aluminum alloy powder is $Al_{90}Fe_6Ti_2Si_2$, where each numerical value represents percent by atom.

7. The process of claim 1, 2, 3 or 4, wherein the first aluminum alloy powder has a particle size of 22 μm or less.

8. The process of claim 1, 2, 3 or 4, wherein said thermal treatment is carried out at a temperature of about 400° C.

9. The process of claim 1, 2, 3 or 4, wherein said metastable phase is an amorphous phase and said stable phase is a crystalline phase.

10. A process for producing a structural member of aluminum alloy having a stable phase, comprising the steps of:

subjecting a first aluminum alloy powder having a metastable phase and an $Al_2O_3$ film on its surface to a thermal treatment, said first aluminum alloy powder exhibiting an exotherm E of $E \geqq 20$ J/g at the time of the phase-transformation of the metastable phase to the stable phase, thereby providing a second aluminum alloy powder having the metastable phase, the $Al_2O_3$ film on its surface and an exotherm E of $E<20$ J/g;

forming a green compact by use of said second aluminum alloy powder;

subjecting the green compact to a heating treatment thereby raising the green compact to a forging temperature and breaking the $Al_2O_3$ film on the surface of the second aluminum alloy powder; and subjecting the green compact, which has been heated to the forging temperature, to a powder forging technique to provide the structural member.

11. A process for producing a structural member of aluminum alloys having a stable phase, comprising the steps of:

subjecting a first aluminum alloy powder having a metastable phase and an $Al_2O_3$ film on its surface to a thermal treatment, said first aluminum alloy powder exhibiting an exotherm E of $E \geqq 20$ J/g and a percent volume shrinkage R of $R>1.2\%$ at the time of the phase-transformation of the metastable phase to the stable phase, thereby providing a second aluminum alloy powder having the metastable phase, the $Al_2O_3$ film on its surface and exhibiting an exotherm E of $E<20$ J/g and a percent volume shrinkage R of $R \leqq 1.2\%$;

forming a green compact by use of said second aluminum alloy powder;

subjecting the green compact to a heating treatment thereby raising the green compact to a forging temperature and breaking the $Al_2O_3$ film on the surface of the second aluminum alloy powder; and subjecting the green compact, which has been heated to the forging temperature, to a powder forging technique to provide the structural member.

12. A process for producing a structural member of aluminum alloy having a stable phase, comprising the steps of:

subjecting a first aluminum alloy powder having a metastable phase and an $Al_2O_3$ film on its surface to a thermal treatment, thereby providing a second aluminum alloy powder having the stable phase, the $Al_2O_3$ film on its surface and exhibiting an exotherm E of $E=0$ J/g and a percent volume shrinkage R of $R \leqq 0\%$;

forming a green compact by use of said second aluminum alloy powder;

subjecting the green compact to a heating treatment thereby raising the green compact to a forging temperature and breaking the $Al_2O_3$ film on the surface of the second aluminum alloy powder; and subjecting the green compact, which has been heated to the forging temperature, to a powder forging technique to provide the structural member.

13. A process for producing a structural member of aluminum alloy having a stable phase, comprising the steps of:

subjecting a first aluminum alloy powder having a metastable phase and an $Al_2O_3$ film on its surface to a thermal treatment, said first aluminum alloy powder exhibiting a percent volume shrinkage R of $R>1.2\%$ at the time of the phase-transformation of the metastable phase, thereby providing a second aluminum alloy powder having the metastable phase, the $Al_2O_3$ film on its surface and exhibiting a percent volume shrinkage R of $R \leqq 1.2\%$;

forming a green compact by use of said second aluminum alloy powder;

subjecting the green compact to a heating treatment thereby raising the green compact to a forging temperature and breaking the $Al_2O_3$ film on the surface of the second aluminum alloy powder; and subjecting the green compact, which has been heated to the forging temperature, to a powder forging technique to provide a structural member.

14. The process of claim 10, 11, 12 or 13, wherein the first aluminum alloy powder is $Al_{91.5}Fe_5Ti_{1.5}Si_2$, where each numerical value represents percent by atom.

15. The process of claim 10, 11, 12 or 13, wherein the first aluminum alloy powder is $Al_{90}Fe_6Ti_2Si_2$, where each numerical value represents percent by atom.

16. The process of claim 10, 11, 12 or 13, wherein the first aluminum alloy powder has a particle size of 22 μm or less.

17. The process of claim 10, 11, 12 or 13, wherein said thermal treatment is carried out at a temperature of about 400° C.

18. The process of claim 10, 11, 12 or 13, wherein said metastable phase is an amorphous phase and said stable phase is a crystalline phase.

* * * * *